US005875616A

United States Patent [19]

Paavola et al.

[11] Patent Number: 5,875,616

[45] Date of Patent: Mar. 2, 1999

[54] WRAPPING MACHINE

[75] Inventors: Jari Paavola, Masku, Finland; Werner Diehl, Tamarac, Fla.

[73] Assignee: Oy M. Haloila, Ab, Masku, Finland

[21] Appl. No.: 956,152

[22] Filed: Oct. 22, 1997

[30] Foreign Application Priority Data

Dec. 12, 1996 [FI] Finland ..... 964819

[51] Int. Cl.[6] ..... B65B 53/00

[52] U.S. Cl. ..... 53/556; 53/588; 425/66

[58] Field of Search ..... 53/441, 556, 588; 264/288.4; 425/66

[56] References Cited

U.S. PATENT DOCUMENTS

| | | | |
|---|---|---|---|
| 4,302,920 | 12/1981 | Lancaster et al. . | |
| 4,387,548 | 6/1983 | Lancaster et al. . | |
| 4,718,219 | 1/1988 | Schmitz | 53/556 |
| 4,747,254 | 5/1988 | Lancaster | 53/556 |
| 5,414,979 | 5/1995 | Moore et al. . | |

FOREIGN PATENT DOCUMENTS

| | | | |
|---|---|---|---|
| 246659 | 11/1987 | European Pat. Off. | 53/441 |
| 871935 | 11/1987 | Finland . | |
| 78433 | 4/1989 | Finland . | |
| 2107668 | 5/1983 | United Kingdom . | |

*Primary Examiner*—Linda Johnson
*Attorney, Agent, or Firm*—Schwartz & Weinrieb

[57] ABSTRACT

A wrapping machine for winding a web (1) of wrapping film from a roller (2) around an object to be packaged. The wrapping machine has a film dispenser (3) which comprises a frame (4) provided with at least one guide means (5, 11) in contact with the first side ($1^1$) of the film 1 to guide the film; an openable gate section (7) provided with at least one guide means (8, 12) which is in contact with the opposite side ($1^2$) of the film relative to the first side, the gate section (7) being pivoted on the frame (4) so that it can be moved between an open position (I) and a closed position (II); and a pre-stretching device (10) for preliminary stretching of the film. The pre-stretching device comprises a first pre-stretching roller (11) and a second pre-stretching roller (12). One of the pre-stretching rollers (11, 12) is connected to the frame (4) and the other one is connected to the gate section (7) in such manner that one of the pre-stretching rollers (11, 12) is disposed in contact with the first side ($1^1$) of the film while the other one is in contact with the other side ($1^2$).

18 Claims, 8 Drawing Sheets

WRAPPING MACHINE

FIELD OF THE INVENTION

The present invention relates generally to a wrapping machine, and more particularly to a wrapping machine having a newly improved wrapping film dispensing and stretching mechanism.

BACKGROUND OF THE INVENTION

Previously known is a wrapping machine for winding a web of wrapping film from a roll around an object to be packaged. The wrapping film consists of a thin plastic film. The wrapping machine is provided with a film dispenser. The film dispenser comprises a frame provided with at least one guide element for guiding the film, which guide element is in contact with a first side of the film. Further, the film dispenser comprises an openable gate section which is provided with at least one guiding device which is in contact with a second side of the film opposite to the first side. The gate section is pivoted on the frame so that it can be moved between an open position and a closed position. Moreover, the film dispenser comprises a pre-stretching device for preliminary stretching of the film. The pre-stretching device comprises two pre-stretching rollers, a first pre-stretching roller which can be run operated at a first circumferential velocity and a second pre-stretching roller which is disposed at a distance from the first pre-stretching roller and can be operated at a second circumferential velocity differing from the first circumferential velocity. The pre-stretching of the film occurs as a result of the two different circumferential speeds of the pre-stretching rollers which are brought into frictional contact with the film portion between the pre-stretching rollers.

In the known apparatus, both pre-stretching rollers are attached to the frame of the film dispenser. Connected to the gate part are guide elements, such as backup rollers, which, in the closed position of the gate, are pressed against the pre-stretching rollers while the film is passing between them along a W-shaped path so that each pre-stretching roller is in contact with the first side of the film on the same side of it and the backup rollers in the gate are in contact with the second side of the film.

A problem with this prior-art apparatus is that it has a complex structure containing many different parts, such as guiding means, rollers, power transmission elements and the like, so the structure is expensive. The film is narrowed too much by the pre-stretching system as the distance between the pre-stretching rollers is relatively long. As the film narrows too much, the film area covering the object being wrapped becomes smaller.

OBJECTS OF THE INVENTIONS

The object of the present invention is to eliminate the drawbacks mentioned above.

A specific object of the invention is to provide a wrapping machine whose film dispenser has a simpler structure and contains fewer parts than earlier machines.

Another object of the invention is to provide a wrapping machine whose film dispenser can be implemented as a smaller and lighter structure than before.

A further object of the invention is to provide a wrapping machine in which the film does not undergo excessive narrowing.

SUMMARY OF THE INVENTION

According to the invention, one of the pre-stretching rollers is connected to the frame and the other one is connected to the gate section in such manner that one of the pre-stretching rollers is in contact with the first side of the film while the other one is in contact with the other side.

The invention has the advantage that the film dispenser can be implemented as a simpler structure than before, using fewer parts, so it becomes small and light. In the film dispenser of the invention, the film passes along an S-shaped path between the pre-stretching rollers and in contact with their external surface, so the pre-stretching rollers can be placed very close to each other, preventing excessive narrowing of the film.

In an embodiment of the wrapping machine, the film dispenser comprises a power means provided with a rotating shaft, the power means being connected to the frame; a first set of power transmission elements for transmitting power from the shaft to rotate the first pre-stretching roller and a second set of power transmission elements for transmitting power from the shaft to rotate the second pre-stretching roller.

In an embodiment of the wrapping machine, the first set of power transmission elements comprises a first wheel connected to the shaft of the power means, a second wheel connected to the first pre-stretching roller, and an endless driving element mounted upon the first and second wheels as an endless loop.

In an embodiment of the wrapping machine, the second set of power transmission elements comprises a third wheel, which is mounted with a bearing on the frame so that it can be rotated by the power means, and a fourth wheel, which is connected to the second pre-stretching roller and adapted to come into power transmitting contact with the third wheel in the closed position of the gate section.

In an embodiment of the wrapping machine, the third wheel is connected to the first pre-stretching roller on the same axle with the second wheel.

In an embodiment of the wrapping machine, the second set of power transmission elements comprises a fifth wheel, which is connected to the first pre-stretching roller on the same axle with the second wheel, a sixth wheel, which is connected to the same shaft with the third wheel, and an endless driving element comprising an endless loop disposed around the fifth and sixth wheels.

In an embodiment of the wrapping machine, the second set of power transmission elements for transmitting power to the second pre-stretching roller consists of an endless driving element and a fourth wheel, which is connected to the second pre-stretching roller and adapted to come into driving engagement with the driving element in the closed position of the gate section.

In an embodiment of the wrapping machine, the endless driving element is an open-link chain, a cogged belt, a trapezoidal belt or the like, and, correspondingly, the fourth wheel is a chain wheel, a cogged pulley, a trapezoidal belt wheel, a toothed gear or the like.

In an embodiment of the wrapping machine, the third wheel and the fourth wheel are toothed gears whose tooth systems are adapted to each other.

In an embodiment of the wrapping machine, the transmission ratio of the power transmission elements is so chosen that the circumferential velocity of the posterior pre-stretching roller as seen in the running direction of the film web is higher than the circumferential velocity of the anterior pre-stretching roller as seen in the running direction.

BRIEF DESCRIPTION OF THE DRAWINGS

Various other objects, features, and attendant advantages of the present invention will be more fully appreciated from the following, detailed description wherein, the invention is described in detail in accordance with embodiment examples by referring to the attached drawings in which like reference characters designate like or corresponding parts throughout the several views, and wherein.

DETAILED DESCRIPTION OF THE ILLUSTRATED EMBODIMENTS

Figure 1:
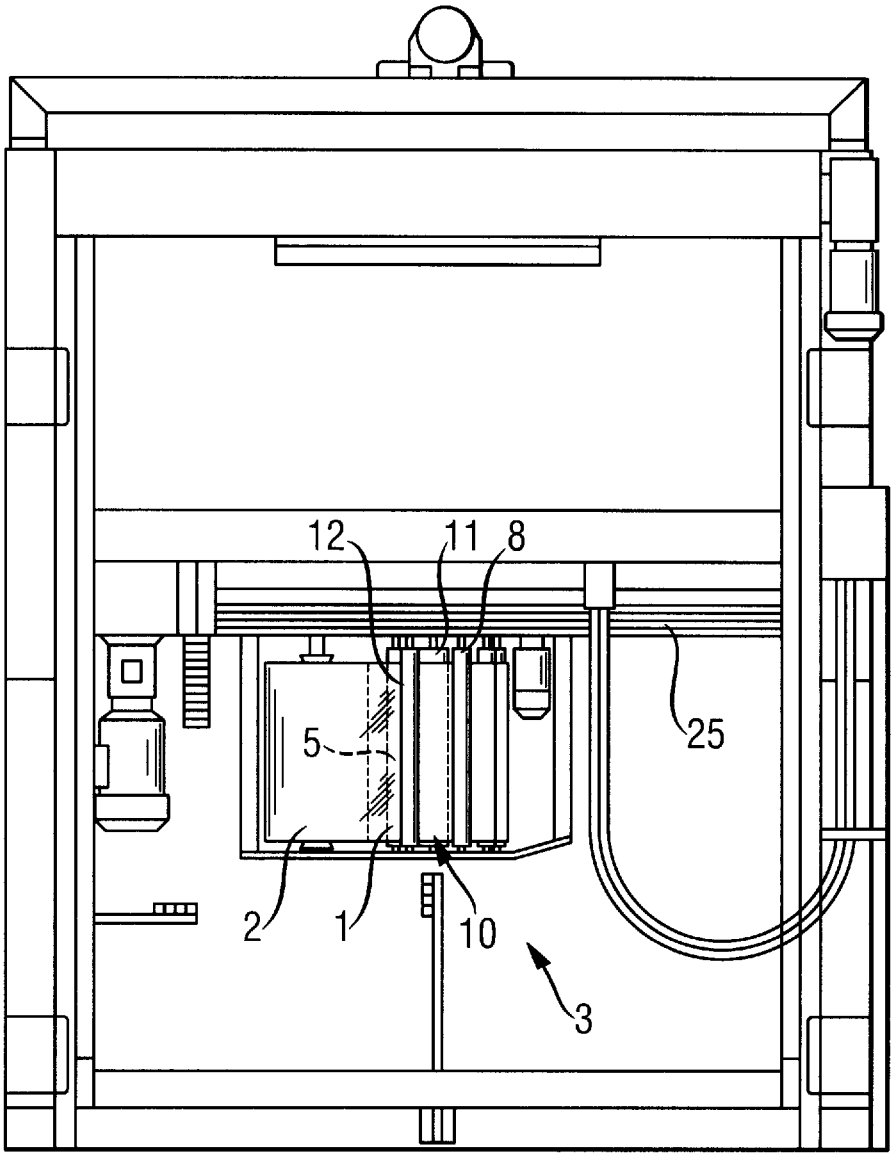
FIG. 1 is a side view of an embodiment of the wrapping machine of the invention.
Figure 2:
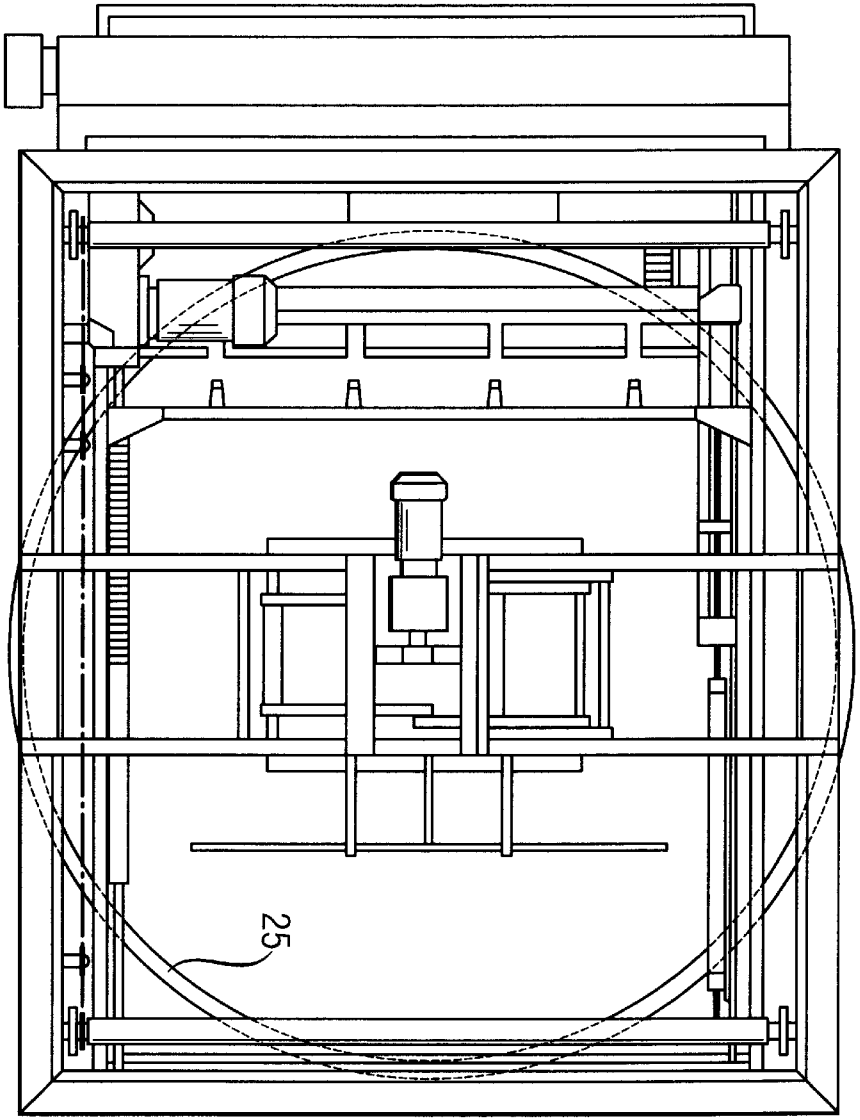
FIG. 2 illustrates the wrapping machine of FIG. 1 in top view.

FIGS. 1 and 2 show a wrapping machine designed for winding a web of wrapping film 1 from a roll 2 around a stationary object to be packaged. The wrapping machine comprises a film dispenser 3. In this exemplary embodiment, the film dispenser 3, carried and guided by a circular guide track 25, moves along a circular path around the object to be wrapped. However, it is to be noted that the film dispenser 3 described in the following can be applied in conjunction with any wrapping machine, such as, for example one in which the film dispenser 3 is connected to a revolving crank which moves the film dispenser 3 around the object to be wrapped, or with a wrapping machine in which the film dispenser 3 is connected to a fixed post and the film is passed around an object that is revolved around the dispenser.

Figure 3:
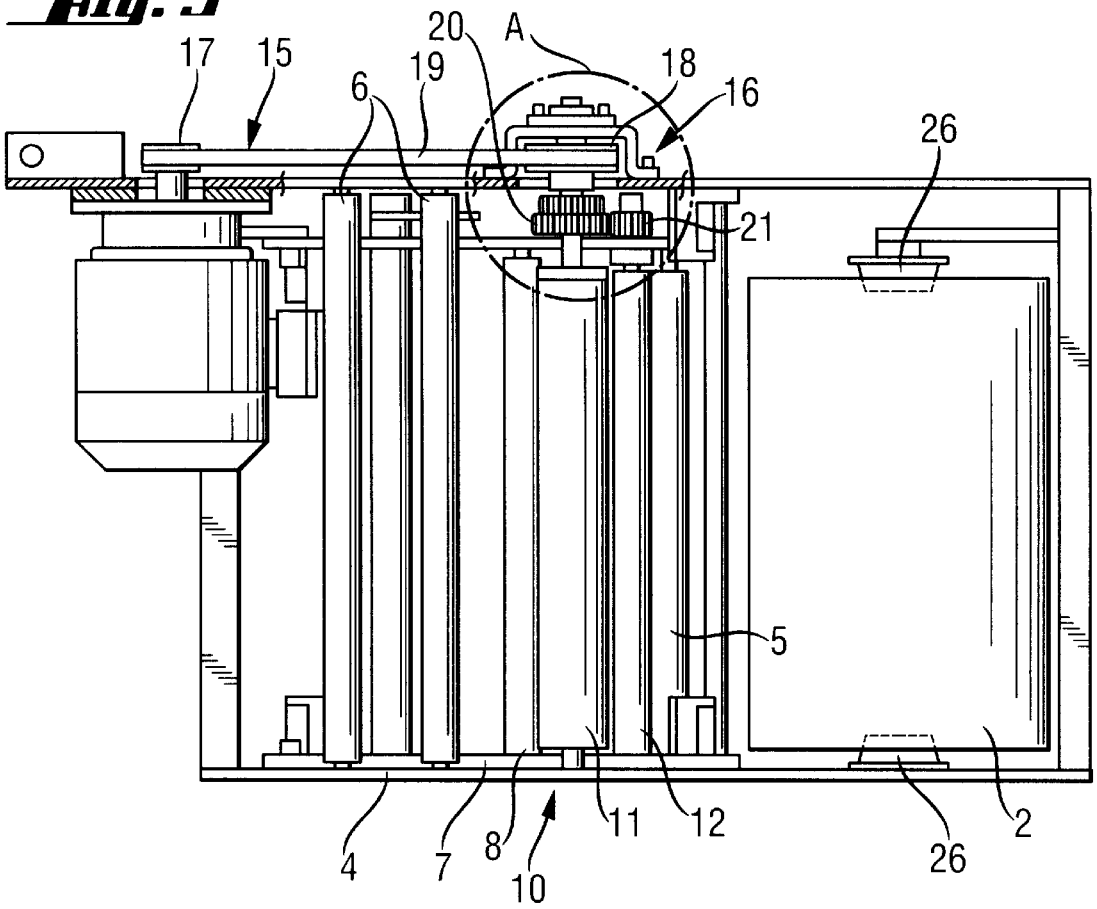
FIG. 3 illustrates the film dispenser of the wrapping machine of the invention in side view.
Figure 5:
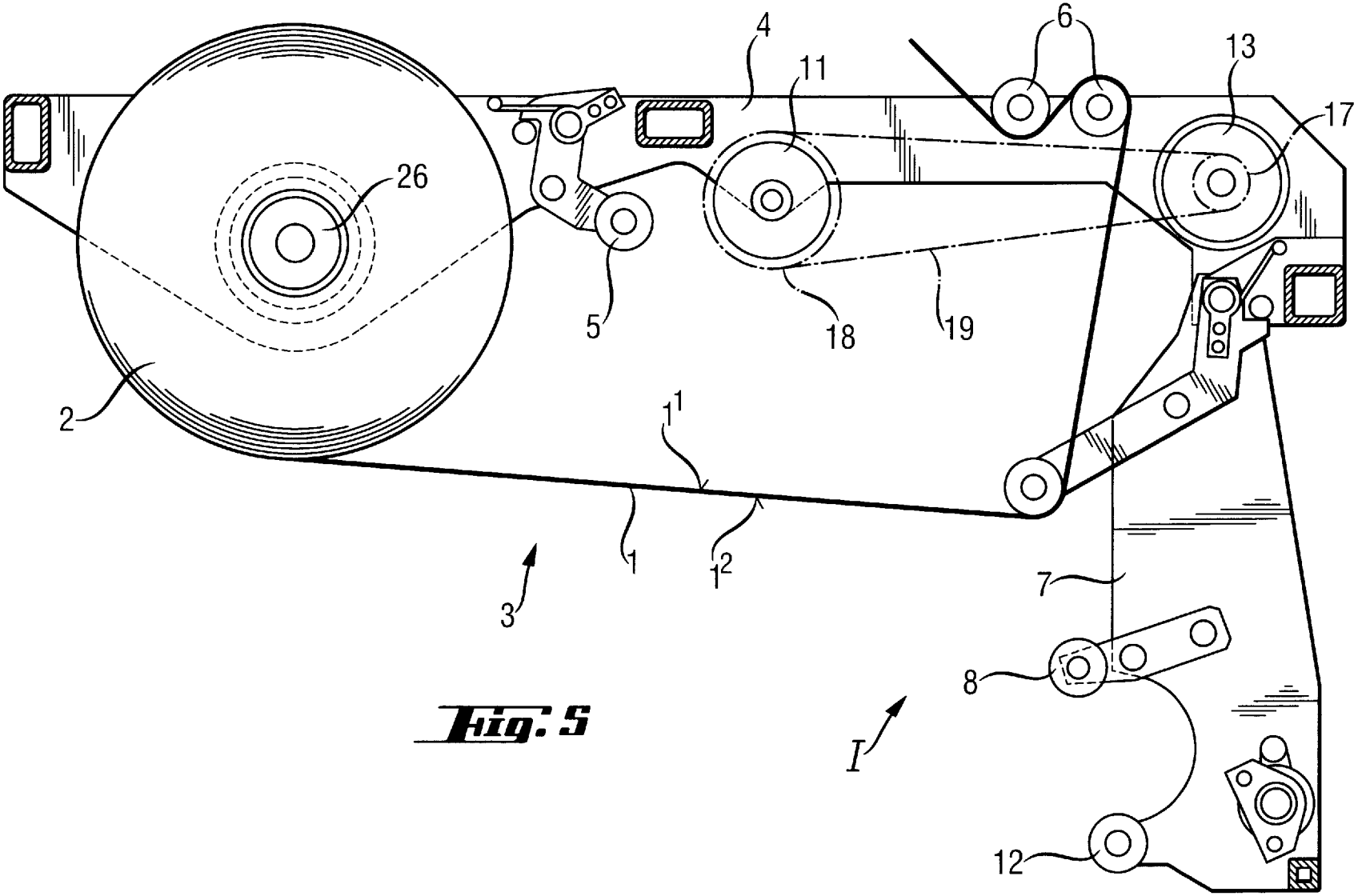
FIG. 5 is a top view of the film dispenser of an embodiment of the wrapping machine of the invention with the gate section in its open position.
Figure 6:
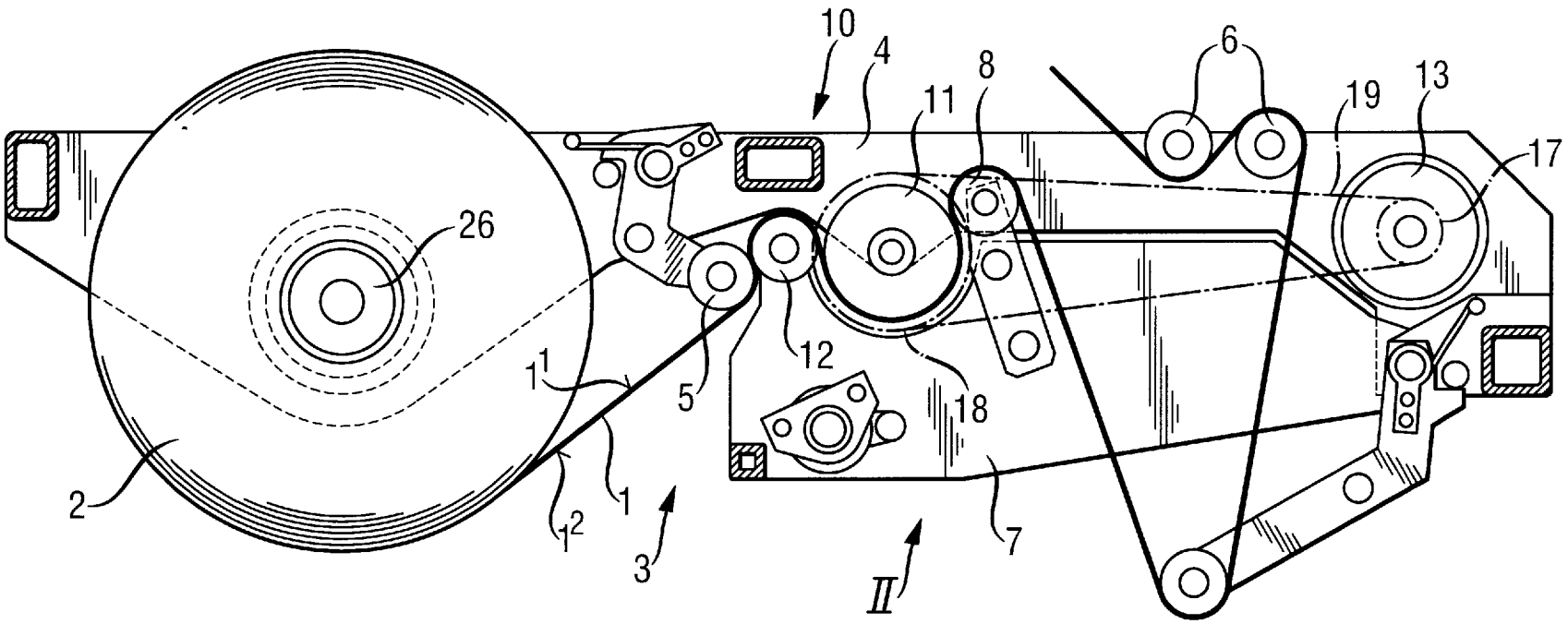
FIG. 6 illustrates the film dispenser of FIG. 5 with the gate section in its closed position.

FIG. 3 and also FIGS. 5–8 show a film dispenser 3, which comprises a frame 4. In the embodiments in FIG. 5 and FIG. 6, the frame 4 is provided with supporting elements 26 allowing the film roll 2 to be detachably mounted. In the apparatus in FIG. 7 and FIG. 8, these supporting elements 26 are located in the openable gate section 7. As seen in FIGS. 5 and 6, the frame 4 is provided with at least one guide means 5, 11, which is in contact with the first side $1^1$ of the film 1, for guiding the film. Furthermore, the film dispenser 3 comprises an openable gate section 7, which is provided with at least one guide means 8, 12, which is in contact with the opposite side $1^2$ of the film 1 relative to the first side. The gate section 7 is pivoted on the frame so that it can be moved between an open position I and a closed position II respectively shown in FIGS. 5 and 6. Moreover, the film dispenser 3 comprises a pre-stretching device 10 for preliminary stretching of the film.

The pre-stretching device 10 comprises two pre-stretching rollers, that is a first pre-stretching roller 11 and a second pre-stretching roller 12. The first pre-stretching roller 11 is rotated so that it has a first circumferential velocity v1. The second pre-stretching roller 12 is located at a distance from the first pre-stretching roller 11 and it is rotated in the opposite direction relative to the first pre-stretching roller 11. The second pre-stretching roller 12 is rotated so that its circumferential velocity v2 differs from the circumferential velocity of the first pre-stretching roller 11. In the running direction of the film web, the circumferential velocity of the posterior pre-stretching roller is less than the circumferential velocity of the first pre-stretching roller 11. The pre-stretching of the film takes place as a result of the different circumferential velocities over the film portion between the pre-stretching rollers 11, 12, which are in frictional contact with the film 1. A sufficient contact area between the film 1 and the pre-stretching rollers 11, 12 is achieved by using backup rollers pressing the film 1 against the pre-stretching rollers 11, 12.

As shown in FIGS. 5–8, one of the pre-stretching rollers 11, 12, in this case the first pre-stretching roller 11, is connected to the frame 4 and the other pre-stretching roller 12 is connected to the gate section 7, so that the first pre-stretching roller 11 is in contact with the first side $1^1$ of the film 1 and the second pre-stretching roller 12 is in contact with the second side $1^2$ of the film 1.

Figure 7:
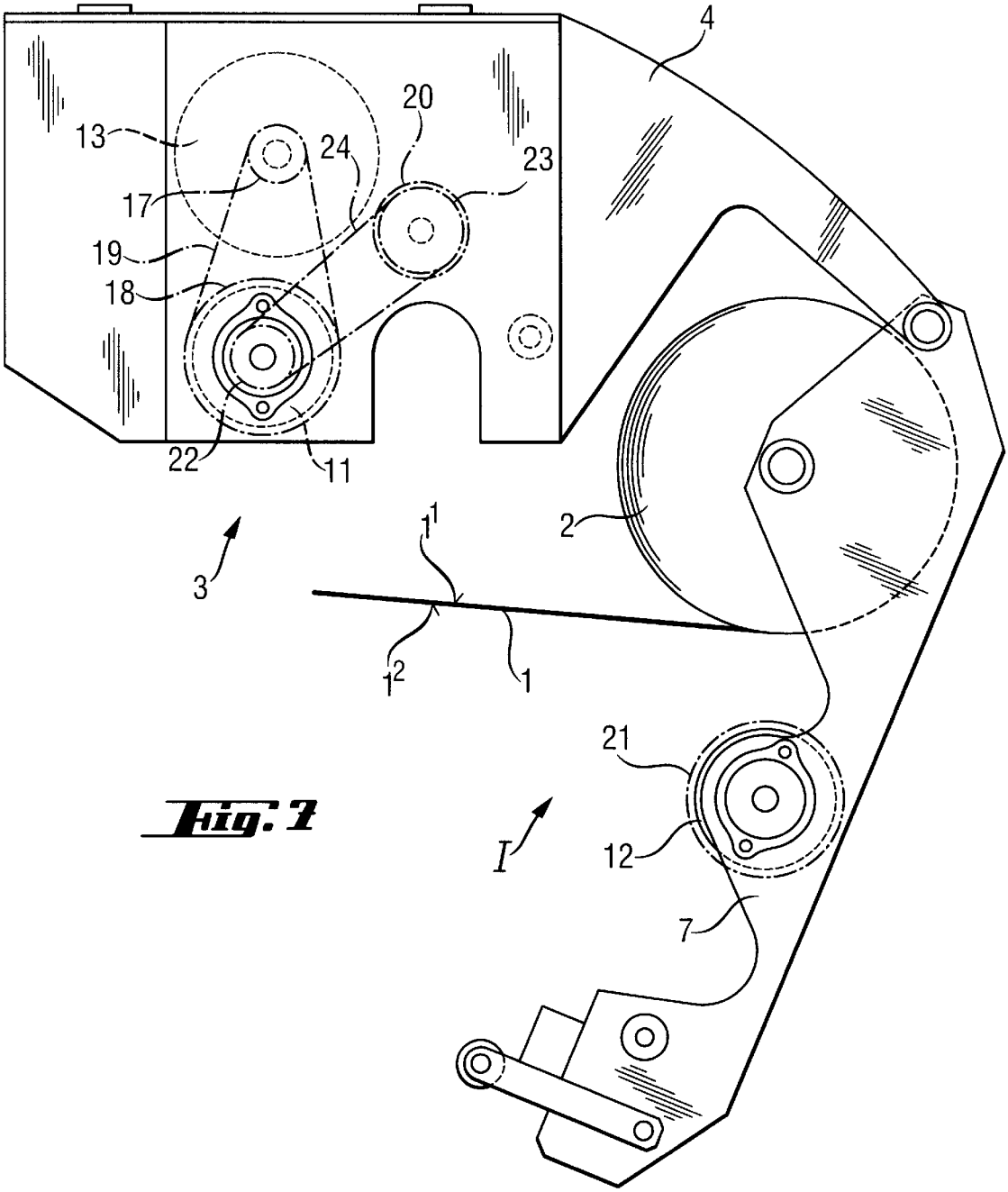
FIG. 7 is a top view of the film dispenser of another embodiment of the wrapping machine of the invention with the gate section in its open position.
Figure 8:
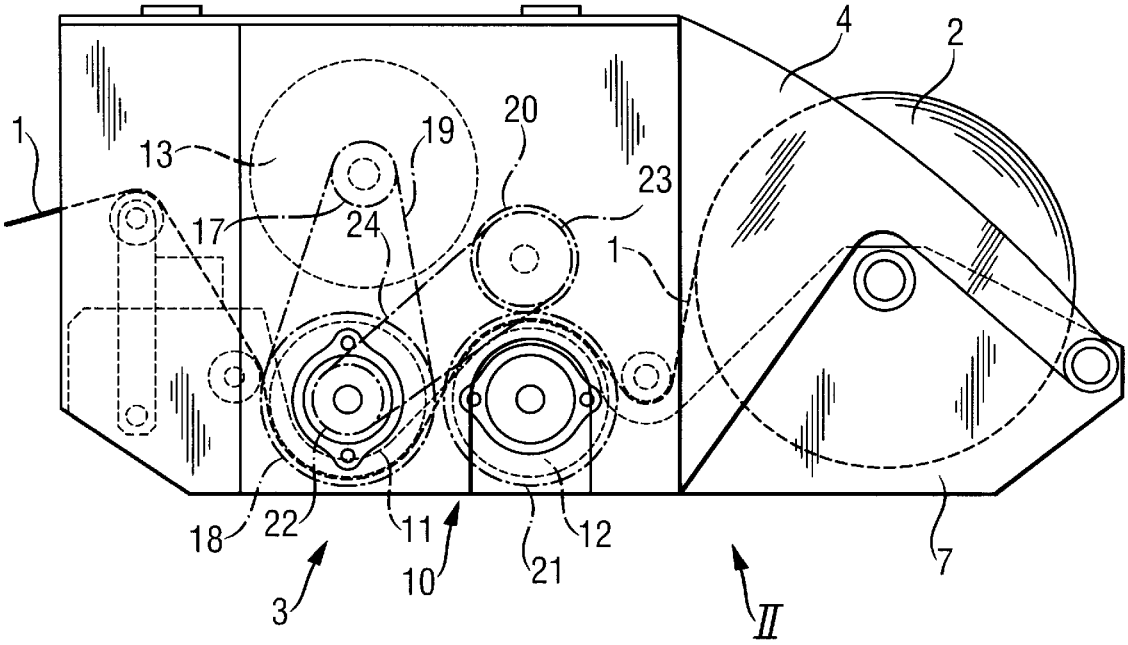
FIG. 8 illustrates the film dispenser of FIG. 7 with the gate section in its closed position.

The main difference between the embodiment in FIGS. 5 and 6 and the embodiment in FIGS. 7 and 8 is the manner in which power is transmitted from the motor 13 to the pre-stretching device 10 and especially to the second pre-stretching roller 12 located in the openable gate section 7. A feature common to both embodiments is that the film dispenser 3 comprises a motor 13 with a rotating shaft 14. The motor 13 is connected to the fixed frame 4. Furthermore, the film dispenser 3 comprises a first set of power transmission elements 15 for transmitting power from the shaft 14 of the motor 13 so as to rotate the first pre-stretching roller 11 and a second set of power transmission elements 16 for transmitting power from the first pre-stretching roller 11 so as to rotate the second pre-stretching roller 12. The first set of power transmission elements 15 comprises a first wheel 17, which is connected to the shaft 14 of the power means 13, a second wheel 1S, which is connected to the first pre-stretching roller 11, and an endless driving element 19 comprising an endless loop over the first and second wheels 17, 18.

Figure 4:
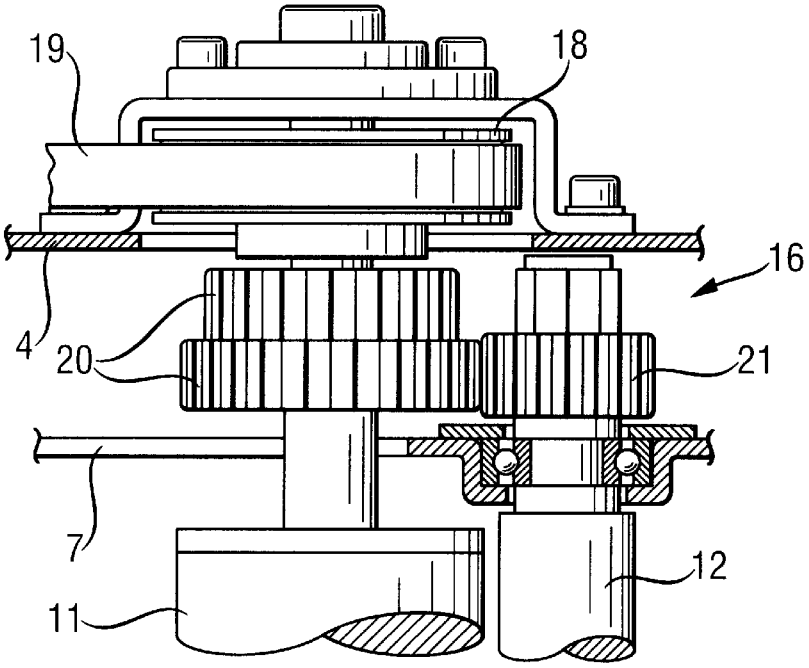
FIG. 4 illustrates detail A of FIG. 3 in a magnified form.
Figure 9:
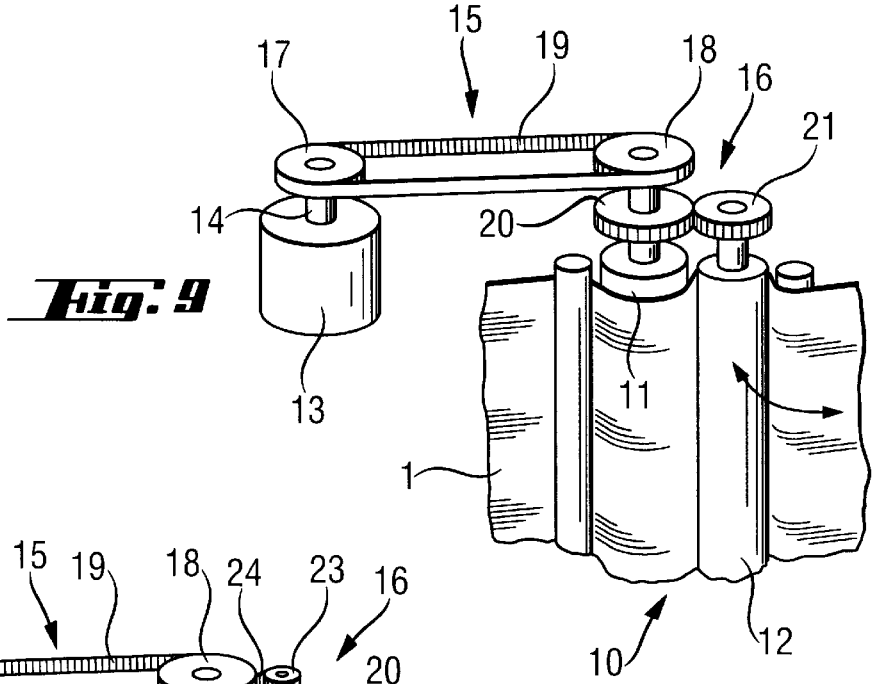
FIG. 9 is a partial perspective view illustrating the principle of the power transmission system of the pre-stretching device of the film dispenser in FIGS. 5 and 6.

FIG. 9 shows a diagram illustrating the principle of how the power transmission is implemented in the embodiment presented in FIGS. 5 and 6. The second set of power transmission elements 16 comprises a third wheel 20, which is mounted with a bearing on the frame 4 and so arranged that it can be rotated by the power means 13, and a fourth wheel 21, which is connected to the second pre-stretching roller 12 and which is adapted to come into power transmitting contact with the third wheel 20 in the closed position II of the gate section 7. The third wheel 20 is connected to the first pre-stretching roller 11 on the same axle with the second wheel 18. The third wheel 20 and the fourth wheel 21 are toothed gears with tooth systems adapted to each other. The teeth mesh when the gate section 7 is closed. The same thing can be seen from FIGS. 3 and 4. The detail illustration A in FIG. 4 shows that there are two different third gear wheels 20 mounted successively on the same axle at the end of the first pre-stretching roller 11 to allow a change of transmission ratio. By replacing the fourth gear wheel 21 mounted on the end of the second pre-stretching roller 12 with a different-sized gear wheel that engages the upper third gear wheel 20, a suitable transmission ratio can be selected, thereby changing the speeds of rotation of the pre-stretching rollers 11, 12. The transmission ratio to be selected depends on the thickness and quality of the film and on the desired degree of preliminary strain.

Figure 10:
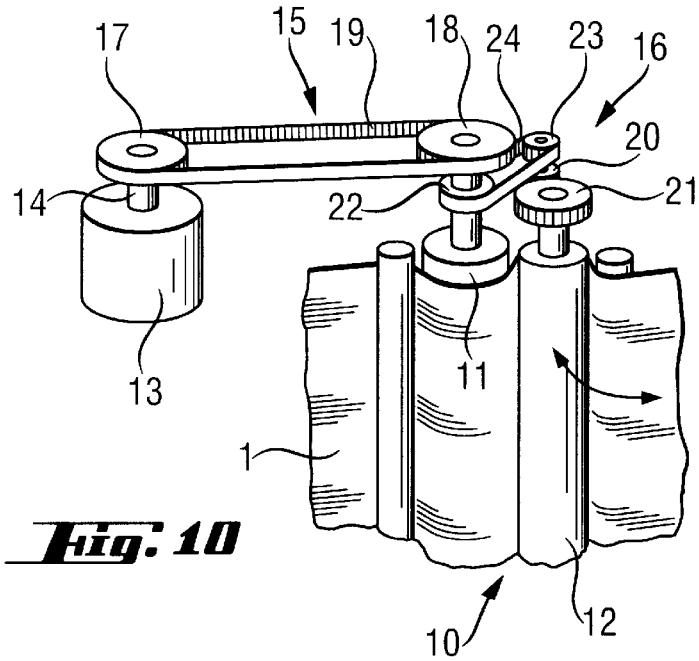
FIG. 10 is a partial perspective view illustrating the principle of the power transmission system of the pre-stretching device of the film dispenser in FIGS. 5 and 6.

FIG. 10 is a diagrammatic illustration of the power transmission application of FIGS. 7 and 8. The second set of power transmission elements 16 comprises a fifth wheel 22, which is connected to the first pre-stretching roller 11 on the same axle with the second wheel 18, a sixth wheel 23, which is connected to the same axle with the third wheel 20, and an endless driving element 24, disposed over the fifth and sixth wheels 22, 23 as an endless loop. Here, too, the third wheel 20 and the fourth wheel 21 are toothed gears with tooth systems adapted to each other. The teeth mesh when the gate section 7 is closed.

Figure 11:
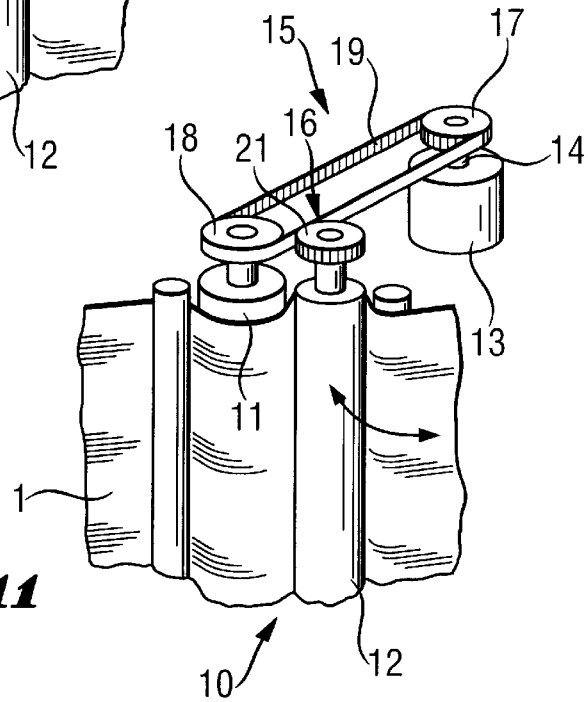
FIG. 11 is a partial perspective view illustrating the principle of a third embodiment of the power transmission system of the pre-stretching device of the film dispenser.

FIG. 11 shows yet another embodiment, in which the second set of power transmission elements 16 for transmitting power to the second pre-stretching roller 12 consists of an endless driving element 19 and a fourth wheel 21 connected to the second pre-stretching roller 12, this fourth wheel 21 being is disposed in to come into driving engagement with the driving element 19 when the gate section 7 is in its closed position II. The endless driving element 19 is an open-link chain, a cogged belt, a trapezoidal belt or the like. The second wheel 18, which is disposed in driving engagement with the driving element 19, is a chain wheel, a cogged wheel, a friction wheel or the like, respectively.

The invention is not limited to the examples of its embodiments described above, but many variations are possible within the framework of the inventive idea defined by the claims. It is therefore to be understood that within the scope of the appended claims, the present invention may be practiced otherwise than as specifically described herein.

We claim:

1. In a wrapping machine for wrapping a wrapping film, supplied from a roll of wrapping film, around an object to be packaged, a film dispensing system comprising:

a supply roll of wrapping film;

a frame member;

a gate member movably mounted with respect to said frame member between a first open position and a second closed position;

pre-stretching means for preliminary stretching a wrapping film supplied from said supply roll of wrapping film and comprising a pair of pre-stretching rollers wherein a first one of said pair of pre-stretching rollers is driven at a first circumferential velocity while a second one of said pair of pre-stretching rollers is driven at a second circumferential velocity which is different from said circumferential velocity of said first one of said pair of pre-stretching rollers, said preliminary stretching of said wrapping film occurring upon a portion of said wrapping film which is interposed between said first and second pre-stretching rollers and as a result of said different circumferential velocities of said first and second pre-stretching rollers;

said first one of said first and second pre-stretching rollers being mounted upon said frame member so as to be disposed in contact with a first side of said wrapping film when said wrapping film is supplied from said supply roll of wrapping film and when said gate member is disposed at said second closed position.

said second one of said first and second pre-stretching rollers being mounted upon said gate member so as to be disposed in contact with a second side of said wrapping film when said wrapping film is supplied from said supply roll of wrapping film and when said gate member is disposed at said second closed position;

a first guide means, mounted upon said frame member and laterally spaced from said first one of said first and second pre-stretching rollers mounted upon said frame member, for engaging said first side of said wrapping film when said wrapping film toward said first and second pre-stretching rollers for pre-stretching of said wrapping film when said wrapping film is supplied from said supply roll of wrapping film and when said said gate member is disposed at said second closed position; and a second guide means, mounted upon said gate member and laterally spaced from said second one of said first and second pre-stretching rollers mounted upon said gate member, for engaging said second side of said wrapping film and guiding said pre-stretched wrapping film away from said first and second pre-stretching rollers when said wrapping film is supplied from said supply roll of wrapping film and when said gate member is disposed at said second closed position.

2. The system as set forth in claim 1, further comprising:

power generating means mounted upon said frame member for providing rotary power to said first and second pre-stretching rollers;

first transmission means for transmitting said rotary power from said power generating means to said first pre-stretching roller; and second transmission means for transmitting said rotary power from said power generating means to said second pre-stretching roller.

3. The system as set forth in claim 2, wherein:

said power generating means comprises a rotary motor.

4. The system as set forth in claim 3, wherein said first transmission means comprises:

a first wheel operatively connected to a rotary drive shaft of said rotary motor;

a second wheel mounted upon said first pre-stretching roller; and a first endless driving element operatively connecting said first and second wheels.

5. The system as set forth in claim 4, wherein said second transmission means comprises:

a third wheel mounted upon said first pre-stretching roller; and a fourth wheel mounted upon said second pre-stretching roller and adapted to operatively engage said third wheel of said first pre-stretching roller when said gate member is disposed at said second closed position.

6. The system as set forth in claim 5, wherein:

said first pre-stretching roller comprises a drive axle; and said second and third wheels are coaxially mounted upon said drive axle of said first pre-stretching roller.

7. The system as set forth in claim 4, wherein said second transmission means comprises:

a third wheel mounted upon said first pre-stretching roller;

a fourth wheel mounted upon a shaft of said frame member;

a second endless driving element operatively connecting said third and fourth wheels;

a fifth wheel coaxially mounted with said fourth wheel upon said shaft of said frame member; and a sixth wheel mounted upon said second pre-stretching roller for engagement with said fifth wheel.

8. The system as set forth in claim 7 wherein:

said first pre-stretching roller comprises a drive axle; and said second and third wheels are co-axially mounted upon said drive axle of said first pre-stretching roller.

9. The system as set forth in claim 4, wherein said second transmission comprises:

a third wheel mounted upon said second pre-stretching roller for engaging said first endless driving element when said gate member is disposed at said second closed position.

10. The system as set forth in claim 9, wherein:

said first endless driving element is selected from the group comprising an open-link chain, a cogged belt, a toothed belt, and a trapezoidal belt; and said third wheel is selected from the group comprising a chain wheel, a cogged pulley, a toothed gear, and a trapezoidal belt wheel.

11. The system as set forth in claim 5, wherein:

said third and fourth wheels comprise toothed gear wheels.

12. The system as set forth in claim 7, wherein:

said fifth and sixth wheels comprise toothed gear wheels.

13. The system as set forth in claim 1, wherein:

said first one of said pair of pre-stretching rollers is driven at a greater circumferential velocity than said second one of said pair of pre-stretching rollers.

14. The system as set forth in claim 1, wherein:

said first and second pre-stretching rollers are disposed adjacent to each other when said gate member is disposed at said second closed position.

15. The system as set forth in claim 14, wherein:

said first guide means disposed upon said frame member is disposed upstream of said first and second pre-stretching rollers, as considered in the direction in which said wrapping film is supplied from said supply roll of wrapping film, when said gate member is disposed at said second closed position, and said second guide means disposed upon said gate member is disposed downstream of said first and second pre-stretching rollers, as considered in said direction in which said wrapping film is supplied from said supply roll of wrapping film, when said gate member is disposed at said second closed position.

16. The system as set forth in claim 15, wherein:

said first guide means disposed upon said frame member is laterally spaced from said first pre-stretching roller mounted upon said frame member, and said second guide means disposed upon said gate member is laterally spaced from said second pre-stretching roller mounted upon said gate member, in such a manner that when said gate member is moved from said first open position to said second closed position, said first guide means, said first pre-stretching roller, said second pre-stretching roller, and said second guide means are interdigitated with each other wherein said second pre-stretching roller disposed upon said gate member is interposed between said first guide means and said first pre-stretching roller disposed upon said frame member, and said first pre-stretching roller disposed upon said frame member is interposed between said second pre-stretching roller and said second guide means disposed upon said gate member.

17. The system as set forth in claim 1, wherein:

said supply roll of wrapping film is mounted upon said frame member.

18. The system as set forth in claim 1, wherein:

said supply roll of wrapping film is mounted upon said gate member.

* * * * *